US008695288B2

(12) United States Patent
Kugler et al.

(10) Patent No.: US 8,695,288 B2
(45) Date of Patent: Apr. 15, 2014

(54) STRUCTURAL SYSTEMS FOR RESTRAINING ELEVATED SURFACE TILES

(75) Inventors: William E. Kugler, Denver, CO (US); Stephen J. Knight, III, Littleton, CO (US)

(73) Assignee: United Construction Products, Inc., Denver, CO (US)

( * ) Notice: Subject to any disclaimer, the term of this patent is extended or adjusted under 35 U.S.C. 154(b) by 0 days.

(21) Appl. No.: 13/433,211

(22) Filed: Mar. 28, 2012

(65) Prior Publication Data

US 2012/0272589 A1 Nov. 1, 2012

Related U.S. Application Data

(63) Continuation-in-part of application No. 13/094,364, filed on Apr. 26, 2011, now Pat. No. 8,387,317.

(51) Int. Cl.

| | |
|---|---|
| ***E04B 2/82*** | (2006.01) |
| ***E04B 9/00*** | (2006.01) |
| ***E04G 1/22*** | (2006.01) |
| ***E04B 1/00*** | (2006.01) |
| ***E04B 5/00*** | (2006.01) |

(52) U.S. Cl.
USPC ..... 52/126.6; 52/126.5; 52/126.7; 52/126.1; 52/263; 52/100

(58) Field of Classification Search
USPC ..... 52/126.6, 126.5, 126.7, 126.1, 263, 100
See application file for complete search history.

(56) References Cited

U.S. PATENT DOCUMENTS

| | | | | |
|---|---|---|---|---|
| 4,085,557 | A | | 4/1978 | Tharp |
| 4,279,109 | A | | 7/1981 | Madl, Jr. |
| 4,922,670 | A | * | 5/1990 | Naka et al. ..... 52/126.6 |
| 4,996,804 | A | | 3/1991 | Naka et al. |
| 5,072,557 | A | | 12/1991 | Naka et al. |
| 5,333,423 | A | | 8/1994 | Propst |
| 5,588,264 | A | | 12/1996 | Buzon |
| 5,791,096 | A | | 8/1998 | Chen |
| 6,189,289 | B1 | | 2/2001 | Quaglia et al. |
| 6,363,685 | B1 | | 4/2002 | Kugler |
| 6,550,195 | B1 | | 4/2003 | Cooper et al. |
| 6,604,330 | B2 | | 8/2003 | Repasky |
| 6,983,570 | B2 | | 1/2006 | Mead |
| 7,140,156 | B1 | | 11/2006 | Lowe et al. |
| 7,360,343 | B1 | | 4/2008 | Spransy et al. |
| 7,386,955 | B1 | | 6/2008 | Repasky |
| 7,650,725 | B2 | | 1/2010 | Mead |
| 2001/0011441 | A1 | | 8/2001 | Jette |
| 2002/0014045 | A1 | | 2/2002 | Jette |

(Continued)

OTHER PUBLICATIONS

Eternoivica Catalogue Price List, pp. 58-67, dated 2008.

(Continued)

*Primary Examiner* — Mark Wendell

(74) *Attorney, Agent, or Firm* — Marsh Fischmann & Breyfogle LLP; Jonathon A. Szumny

(57) ABSTRACT

A system for assembling a building surface and a building surface assembly that include surface tiles and stability members disposed between the surface tiles to restrict relative movement therebetween. The stability members may advantageously be placed between outer edge segments of the building surface tiles to restrict relative movement of adjacent surface tiles, such as due to seismic activity, vibrations, or high winds. The building surface tiles may include structures such as engagement channels for receiving and engaging the stability members.

55 Claims, 8 Drawing Sheets

(56) References Cited

U.S. PATENT DOCUMENTS

| | | | |
|---|---|---|---|
| 2002/0148173 | A1 | 10/2002 | Kugler |
| 2004/0035064 | A1 | 2/2004 | Kugler et al. |
| 2004/0261329 | A1 | 12/2004 | Kugler et al. |
| 2005/0066597 | A1 | 3/2005 | Chen et al. |
| 2010/0051763 | A1 | 3/2010 | Knight, III et al. |
| 2010/0281789 | A1 | 11/2010 | Vac |
| 2011/0011012 | A1 | 1/2011 | Knight, III et al. |
| 2011/0016809 | A1 | 1/2011 | Knight, III et al. |
| 2011/0023385 | A1 | 2/2011 | Knight, III et al. |
| 2011/0239550 | A1 | 10/2011 | Kugler et al. |

OTHER PUBLICATIONS

Brochure entitled Exotic Wood Tile Installations, Bison Deck Supports, a United Construction Products, Inc. Company, dated Jun. 2007.

Ironwoods Elevated Deck Tile Systems with Hanover Pedestals, Website retrieved Jun. 12, 2009.

* cited by examiner

STRUCTURAL SYSTEMS FOR RESTRAINING ELEVATED SURFACE TILES

RELATED APPLICATIONS

This application claims priority as a Continuation-In-Part of U.S. patent application Ser. No. 13/094,364, filed Apr. 26, 2011, now U.S. Pat. No. 8,387,317, issued Mar. 5, 2013, and entitled "SYSTEMS AND SUPPORT ASSEMBLIES FOR RESTRAINING ELEVATED DECK COMPONENTS", which is incorporated herein by reference in its entirety.

BACKGROUND OF THE INVENTION

1. Field of the Invention

This invention relates to the field of structural systems for restraining surface tiles such as for elevated floors, decks and walkways.

2. Description of Related Art

Building surfaces such as elevated floors, decks, terraces and walkways are desirable in many environments. One system for creating such assembled surfaces includes a plurality of surface tiles, such as concrete tiles (e.g., pavers), stone tiles or wood tiles and a plurality of spaced-apart support pedestals upon which the surface tiles are placed to be supported above a fixed surface, such as a roof. The surface may be elevated above a fixed surface by the support pedestal to promote drainage, to provide a level structural surface for walking, and/or to prevent deterioration of or damage to the surface tiles, or to a substrate below the tiles. The support pedestals can have a fixed height, or can have an adjustable height such as to accommodate variations in the contour of the fixed surface upon which the pedestals are placed, or to create desirable architectural features. The surface tiles may also be supported by other structures (e.g., by structural beams) in addition to, or in lieu of, the support pedestals.

Although a variety of shapes are possible, in many applications the surface tiles are generally rectangular in shape, having four corners. In the case of a rectangular shaped tile, each of the spaced-apart support pedestals can support four adjacent surface tiles at the tile corners. Stated another way, each rectangular surface tile can be supported by four pedestals that are disposed under each of the corners of the tile.

It is also known that large or heavy tiles can be supported by additional pedestals at positions other than at the corners of the tiles to provide increased structural stability. For example, a tile may be supported by a pedestal disposed directly beneath a central portion of the tile. Further, in some applications it is desirable to support the tiles along an outer edge (e.g., between corners of the surface tiles) in addition to supporting the corners of the tiles.

One example of a support pedestal is disclosed in U.S. Pat. No. 5,588,264 by Buzon, which is incorporated herein by reference in its entirety. The support pedestal disclosed by Buzon can be used in outdoor or indoor environments and is capable of supporting heavy loads applied by many types of building surfaces. The support pedestal generally includes a threaded base member and a threaded support member that is threadably engaged with the base member to enable the height of the support pedestal to be adjusted by rotating the support member or the base member relative to the other. The support pedestal can also include an extender or coupler member disposed between the base member and the support member for further increasing the height of the pedestal, if necessary. Alternatively, support members, extenders or coupler members may be in the form of a pipe or box-shaped support that may be cut to length.

SUMMARY OF THE INVENTION

One problem associated with some systems and structural assemblies for supporting (e.g., elevating) surfaces formed with discrete surface tiles is that the support structures may not adequately restrict relative lateral and/or vertical movement between adjacent surface tiles. This failure of current structural systems may become more pronounced when the structures are utilized in seismically active geographic areas or other locations that may be subject to disruptive vibrations of the fixed surface upon which the structures are placed, or are utilized in exterior environments that may be subject to high wind conditions. More particularly, disruptive vibrations or high winds may cause relative lateral and/or vertical movement between surface tiles when the surface tiles are not adequately restricted from such relative movement, and this situation may result in increased stress being placed on the surface tiles (e.g., when adjacent surface tiles strike one another) and on the support structure itself. Further, while some structural systems provide a means to anchor corner portions of the surface tiles to an underlying support, it has been found that the corner portions are often too weak to safely and securely restrict movement of the surface tiles. This problem is particularly significant for surface tiles fabricated from brittle materials, such as concrete or stone and for larger surface tiles such as large wooden surface tiles.

It is therefore an objective to provide a structural system for assembling a surface (e.g., an elevated surface) that has improved structural stability compared to existing systems, particularly in areas that are prone to disruptive vibrations and/or high winds. In one embodiment, a structural system for supporting a plurality of building surface tiles is provided. The system includes a plurality of support pedestals and a plurality of stability members. The support pedestals may include a support plate having a top surface and being configured to operatively support a plurality of building surface tiles in horizontally spaced-apart relation, e.g., when the support pedestals are placed upon a fixed surface. The stability members are configured to be disposed between adjacent building surface tiles that are operatively arranged to form a building surface. In this regard, the stability members may include a central portion and a stabilizing arm extending horizontally away from the central portion, where the stabilizing arm has a top edge, a bottom edge, and at least a first tile-engaging element protruding laterally from a first side of the stabilizing arm between the top edge and the bottom edge.

The foregoing embodiment is subject to a number of characterizations. In one characterization, the stabilizing arms further include at least a second tile engaging element protruding laterally from the stabilizing arm between the top edge and the bottom edge. For example, the first tile engaging element may protrude from a first side of the stabilizing arm and the second tile engaging element may protrude from a second side of the stabilizing arm opposite the first side. The first and second tile engaging elements may include horizontally extending ribs laterally protruding from the first and second sides of the stabilizing arm. The first and second tile engaging elements may also include a horizontally extending arcuate surface portion laterally protruding from the first and second sides of the stabilizing arm. In another example, the first and second tile engaging elements may include a horizontally extending oblique surface portion laterally protruding from the sides of the stabilizing arm.

In another characterization, the stabilizing arm may include an inner hollow portion adjacent to the first tile engaging element. In another characterization, the stability members may include a vertically extending aperture disposed through the stability members. In this regard, the system may further include a plurality of mechanical fasteners that are configured to be placed through the vertically extending apertures to secure the stability members to the support plates.

In another characterization, the stabilizing arm has a length of at least about ¼ inch. In another characterization, the first tile engagement element protrudes laterally from the stabilizing arm by at least about 1/32 inch. For example, the first tile engagement element may protrude laterally from the stabilizing arm by at least about ⅛ inch. In another characterization, the support pedestals include a base plate and a central section interconnecting the base plate and the support plate. In yet another characterization, the stability members are fabricated from a material selected from the group consisting of wood, natural stone, concrete, metal, polymers, plastic or composites thereof.

According to another embodiment, a system for assembling a building surface is provided. The system includes a plurality of building surface tiles and a plurality of stability members. The building surface tiles include a top surface, a plurality of corner portions, and a plurality of outer edge segments disposed between the corner portions, where the outer edge segments extend downwardly from the top surface and have an outer edge segment thickness. The stability members are configured to be placed between two adjacent outer edge segments of two adjacent building surface tiles, such that the stability members are disposed below the top surfaces of the building surface tiles and are at least partially disposed within adjacent stability member engaging portions that are disposed in the two adjacent outer edge segments of the two adjacent building surface tiles.

The foregoing embodiment may also be subject to a number of characterizations. For example, the system may include a plurality of support pedestals that are configured to vertically elevate the building surface tiles above a fixed surface, such as where the support pedestals include a support plate having a top surface that is configured to support the building surface tiles.

In another characterization, the stability members may include a washer form having an outer periphery. For example, the stability member engaging portions may include an engagement channel formed in the outer edge segments, where the washer forms are configured to simultaneously be engaged within adjacent engagement channels to restrict movement (e.g., vertical and/or horizontal movement) of the building surface tiles relative to each other. In one aspect the outer periphery of the washer forms has a thickness that is approximately equal to or slightly less than the width of the engagement channels, e.g., such that the washer form top and bottom surfaces contact top and bottom surfaces of the engagement channels.

In another characterization, the stability members may include a stabilizing arm horizontally extending along a length of the stability members. For example, the stabilizing arm may horizontally extend from a central portion of the stability members. In one aspect, the stabilizing arm may include at least a first tile engagement element protruding laterally from a first side of the stabilizing arm. The stabilizing arm may also include at least a second tile engagement element protruding laterally from the stabilizing arm. In this regard, the first tile engaging element may protrude from a first side of the stabilizing arm and second tile engaging element may protrude from a second side of the stabilizing arm. For example, the first and second tile engaging elements may include horizontally extending ribs laterally protruding from the sides of the stabilizing arm. The first and second tile engaging elements may also include a horizontally extending arcuate surface portion laterally protruding from the sides of the stabilizing arm. In another aspect, the first and second tile engaging elements may include a horizontally extending oblique surface portion laterally protruding from the sides of the stabilizing arm. In any of the foregoing characterizations, the stability member engaging portions may include an engagement channel disposed in the tile for operatively receiving the tile engaging element. The engagement channels may extend along a portion of the outer edge segments of the building surface tile, such as where the engagement channels transect a central portion of the outer edge segments of the building surface tiles. In one aspect, the engagement channels do not transect the corner portions of the surface tiles.

According to another characterization, the building surface tiles are fabricated from concrete. In another aspect, the building surface tiles are fabricated from a material selected from the group consisting of wood, stone, plastic, metal and composites.

In another characterization, the building surface tiles include at least three corner portions and at least three edge segments. In another characterization, the outer edge segment thickness is at least about 1 inch and is not greater than about 3 inches. In yet another characterization, the system further includes mechanical fasteners that are configured to secure the stability members to an underlying support. For example, the stability members may optionally include a vertically extending aperture disposed through the stability member that is configured to operatively receive the mechanical fasteners therethrough.

In another embodiment, a building surface assembly is provided. The building surface assembly may include a plurality of building surface tiles and a plurality of stability members that are operatively interconnected to restrict relative movement of the surface tiles. The building surface tiles may include a top surface, a plurality of corner portions, and a plurality of outer edge segments disposed between the corner portions, the outer edge segments extending downwardly from the top surface and having an outer edge segment thickness. The stability members are disposed between adjacent edge segments of adjacent building surface tiles and are operatively engaged with the outer edge segments of the building surface tiles to restrict relative movement of the surface tiles.

This embodiment may also be subject to a number of characterizations. In one characterization, the stability members are secured to an underlying tile support. In one characterization, the assembly further includes a plurality of support pedestals, at least a portion of the support pedestals being disposed beneath outer edge segments of the adjacent building surface tiles to vertically support and elevate the building surface tile above a fixed surface, where the support pedestals comprise a support plate having a tile support surface that supports the building surface tiles.

In another characterization, the stability members include a washer form having an outer periphery. For example, the outer periphery of the washer form may simultaneously engage the engagement channels of adjacent surface tiles to restrict relative movement of the surface tiles. The outer periphery of the washer form may have a thickness that is approximately equal to or is slightly less than the width of the engagement channel.

In another characterization, the stability members include a stabilizing arm horizontally extending along a length of the stability members. In one aspect, the stabilizing arm horizontally extends from a central portion of the stability members. For example, the horizontally extending stabilizing arm may include horizontally extending ribs laterally protruding from a side of the stabilizing arm such that the ribs frictionally engage the outer edge segments of the surface tiles. In another characterization, the outer edge segments may include stability member engaging portion, wherein the stability arms are operatively engaged with the stability member engaging portions. For example, the stabilizing arms may include at least a first tile engaging element that laterally protrudes from a first side of the stabilizing arms wherein the stability member engaging portions disposed in the surface tiles comprise an engagement channel that operatively receives the first tile engaging element. For example, the stabilizing arm may further include at least a second tile engaging element laterally protruding from a second side of the stabilizing arm. The first and second tile engaging elements may include horizontally extending arcuate surface portions laterally protruding from the sides of the stabilizing arm. Further, the first and second tile engaging elements may include a horizontally extending oblique surface portion laterally protruding from the sides of the stabilizing arm.

In another characterization, the engagement channels may extend along a portion of the edge segments of the surface tiles. For example, the engagement channels may transect a central portion of the edge segments of the surface tiles. In a further characterization, the engagement channels do not transect the corner portions of the surface tiles.

In another characterization, the surface tiles may be fabricated from concrete. In another characterization, the surface tiles may be fabricated from a material selected from a group consisting of wood, stone, plastic, metal and composites. In yet another characterization, the building surface tiles may include at least three corner portions and at least three edge segments. In yet another characterization, the system may further include a plurality of mechanical fasteners securing the stability members to the underlying support. For example, the stability members may include vertically extending apertures therethrough that operatively receive the mechanical fasteners. The underlying support may include the top surface of a support pedestal.

DESCRIPTION OF THE INVENTION

Figure 1:
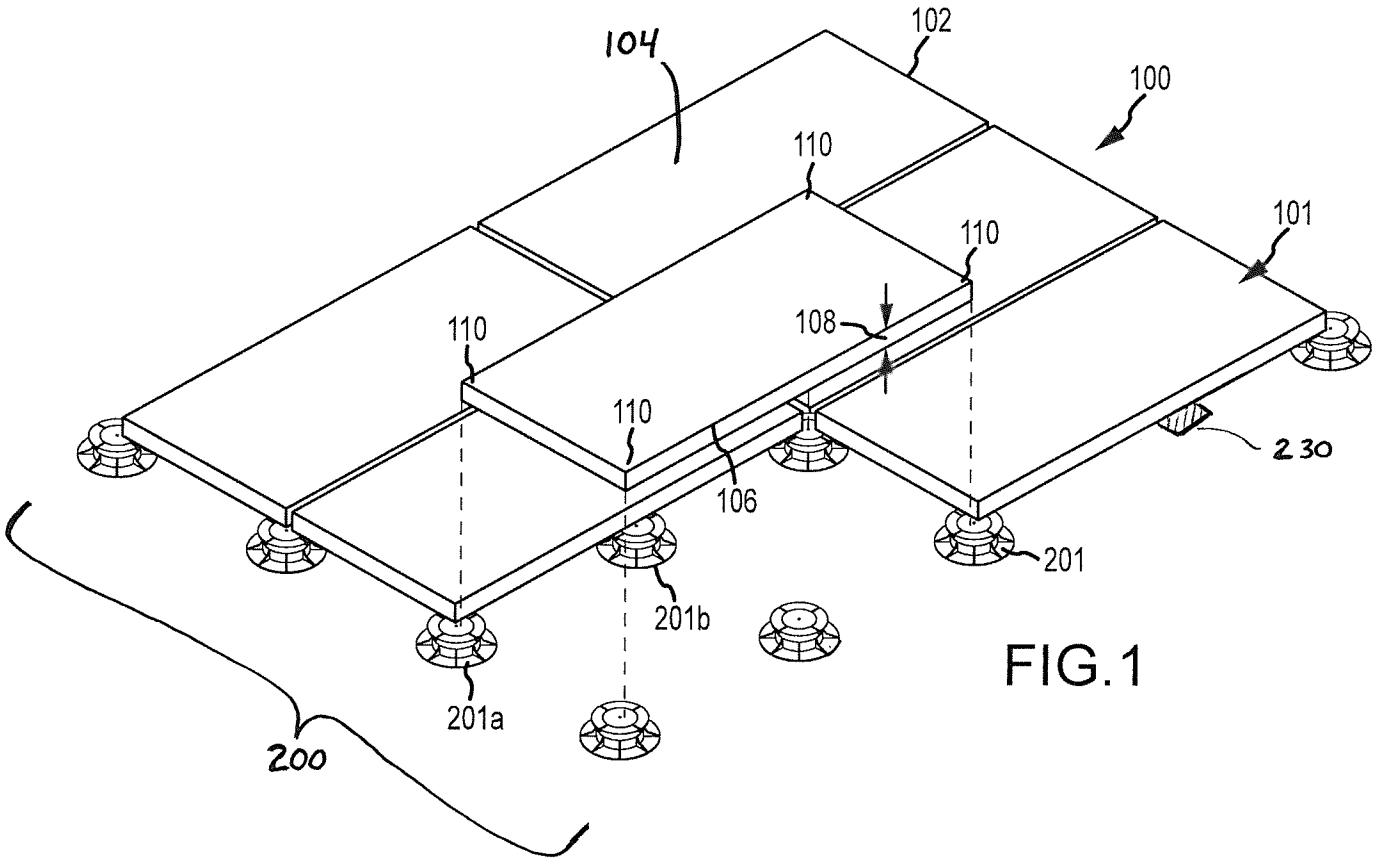
FIG. 1 illustrates a perspective view of a building surface assembly.

FIG. 1 illustrates a perspective view of a building surface assembly 100 with one surface tile removed for purposes of illustration. The assembly 100 includes a building surface 101 (e.g., a horizontally disposed surface) formed from a plurality of discrete surface tiles 102 that are elevated above a fixed surface (not shown) in spaced-apart relation by a support structure 200. The support structure 200 includes a plurality of spaced-apart support pedestals 201, each of which is adapted to be disposed beneath one or more surface tiles 102 to elevate the surface tiles 102 above the fixed surface. The elevated building surface assembly 100 may be used for both interior and exterior applications. The building surface 101 may be elevated above the fixed surface to promote drainage, to provide a level structural surface for walking, and/or to prevent deterioration of or damage to the surface tiles 102. Further, although illustrated as a substantially flat, continuous horizontal surface, the building surface 101 may also include surface tiles 102 at different elevations, e.g., to create desirable aesthetic or functional features such as steps.

The surface tiles 102 may be comprised of virtually any material from which a building surface 101 is constructed. Examples include, but are not limited to, slate tiles, natural stone tiles, plastic tiles, composite tiles, concrete tiles (e.g., pavers), wooden deck tiles, including hardwood deck tiles, tiles of metal, fiberglass grating, rubber tiles and the like. The surface tiles 102 illustrated in FIG. 1 are rectangular in shape. However, surface tiles may be square or any other appropriate shape (e.g., polygonal shapes such as hexagonal or triangular) and the building surface 101 may include combinations of different shapes and/or different sizes of surface tiles 102. As illustrated in FIG. 1, each surface tile 102 may include a top surface 104, outer edge segments 106 having an outer edge thickness 108, and a plurality of corner portions 110.

During assembly the support pedestals 201 may be placed in spaced-apart relation on fixed surfaces including, but not limited to, rooftops, on-grade (e.g., natural ground), over concrete slabs including cracked concrete slabs, and may be placed within fountains and water features, used for equipment mounts, and the like. Further, although illustrated in FIG. 1 as being laid out in a symmetric pattern, the support pedestals 201 may also be laid out in various configurations as may be dictated by the shape and size of the surface tiles 102.

Although the support structure 200 is described and illustrated herein as being comprised of support pedestals 201, the support structure 200 may include other structural elements to support the tiles 102 in addition to, or in lieu of, support pedestals. For example, the support structure 200 may include structural beams upon which the surface tiles 102 are placed. Also, the support structure 200 may include bracing elements 230 (e.g., metal plates or channels) that are configured to attach to two adjacent surface tiles (e.g., using an adhesive) to provide securement of the adjacent surface tiles to each other.

A support pedestal such as support pedestal 201*a* may be disposed beneath the corner portions 110 of adjacent surface tiles 102. Other support pedestals such as support pedestal 201*b* may be disposed under the outer edge segments 106 of the surface tiles 102. That is, support pedestals such as support pedestal 201*b* may be placed between the corner portions 110 and proximate to a central portion of the outer edge segment 106. Such a configuration may be desirable when using very heavy and/or very large surface tiles, such as large concrete surface tiles, or the like. Although not illustrated, support pedestals may be disposed in other locations, such as below a central portion of the surface tiles 102.

The support pedestals 201 forming the support structure 200 may be fixed-height, height-adjustable support pedestals or any combination, and may be constructed of any appropriate materials (e.g., plastic). For example, referring to FIG. 2, a support pedestal 201 may broadly include a base member 212 including a base member extension 214 (e.g., a cylindrical base member extension) that extends upwardly from a base member plate 215 (e.g., a base plate) when the support pedestal 201 is operatively placed on a fixed surface. The base member 212 may include base member threads (not visible) on a surface of the base member extension 214, e.g., internal or external threads.

Figure 2:
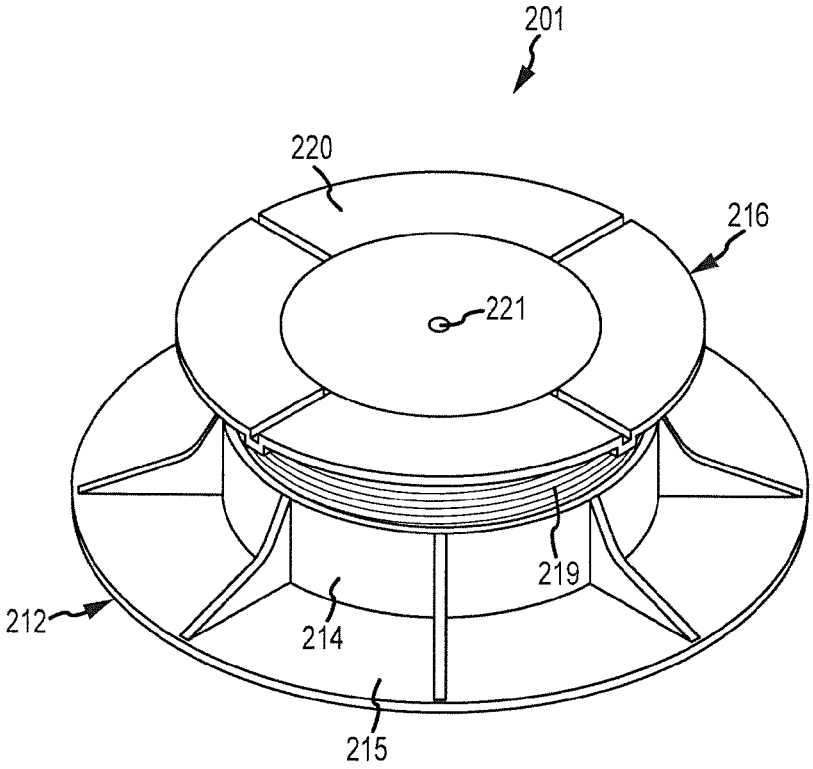
FIG. 2 illustrates a perspective view of a support pedestal.

With continued reference to FIG. 2, a support member 216 is configured to be operatively connected to the base member 212 and includes a support plate 220 and a support member extension 219 (e.g., a cylindrical support member extension) that extends downwardly from the support plate 220. The support member 216 may include support member threads, e.g., external or internal threads, on the support member extension 219 that are adapted to threadably engage base member threads to connect the support member 216 to the base member 212, more specifically to operatively attach the support member extension 219 to the base member extension 214. Thus, the support member 216 may be mated directly to base member threads 218 and may be rotated relative to the base member 212 (or vice versa) to adjust the height of the support pedestal 201. The support plate 220 is thereby disposed above the base member 212 to support a surface tile 102 thereon. The support plate 220 may also include an aperture 221 such as one configured to receive a mechanical fastener therethrough.

Those of skill in the art will appreciate that many other types of support pedestals may be utilized in connection with the present invention. Exemplary support pedestals are disclosed in U.S. Pat. No. 5,588,264 by Buzon, U.S. Pat. No. 6,363,685 by Kugler, U.S. Patent Publication No. 2004/0261329 by Kugler et al.; U.S. Pat. No. 7,921,612 by Knight, III et al.; and U.S. Patent Publication No. 2011/0023385 by Knight, III et al. Further, the support pedestals may be interconnected such as in the manner disclosed in U.S. Patent Publication No. 2011/0011012 by Knight, III et al. Each of the foregoing U.S. Patents and Patent Publications is incorporated herein by reference in its entirety. Also, as is noted above, the surface tiles may be supported by other means, such as by structural beams.

Broadly characterized, the present invention provides a structural system for assembling a building surface that includes a plurality of building surface tiles and also includes a plurality of stability members that are configured to be placed between two adjacent outer edge segments of two adjacent building surface tiles such that the stability members are disposed between and engage the two adjacent outer edge segments to operatively restrict movement (e.g., horizontal and/or vertical movement) of the two adjacent surface tiles relative to each other. Such a system is particularly advantageous when the system is assembled in areas that are prone to periodic vibrations such as due to seismic activity or man-made activity (e.g., a train station). Such systems are also particularly useful for assembling building surfaces in areas that are prone to high winds (e.g., on roof tops), as high winds can cause uplift of the surface tiles.

Figure 3:
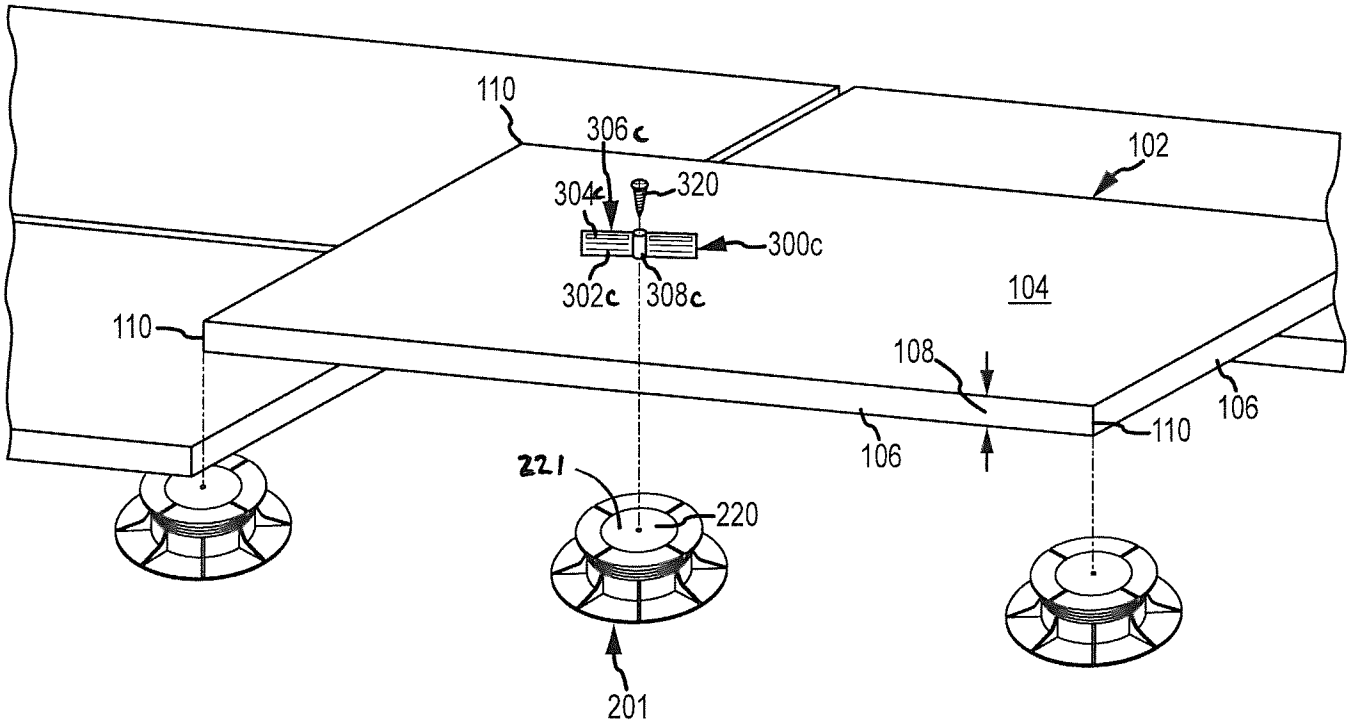
FIG. 3 illustrates an exploded perspective view of a building surface assembly.

FIG. 3 illustrates an exemplary embodiment of a system for the assembly of a building surface in accordance with an embodiment of the invention. The system includes a plurality of discrete building surface tiles 102 that may be disposed in spaced-apart relation to form a building surface. As illustrated in FIG. 3, the building surface tiles 102 may each include a top surface 104, a plurality of corner portions 110 and a plurality of outer edge segments 106 that extend downwardly from the top surface 104 and have an outer edge segment thickness 108. By way of example, the outer edge segment thickness 108 may be of at least about 1 inch and not greater than about 3 inches.

A stability member 300*c* is configured to be placed between two adjacent outer edge segments 106 of two adjacent building surface tiles 102, such that the stability member 300*c* restricts relative movement of the two adjacent building surface tiles when the stability member 300*c* is operatively disposed between the outer edge segments 106. For purposes of clarity, FIG. 3 only illustrates one of the two adjacent surface tiles between which the stability member 300*c* is disposed.

The stability member 300*c* includes a stabilizing arm 306*c* that horizontally extends along a length of the stability member 300*c*. As illustrated in FIG. 3, the stabilizing arm 306*c* extends away from a central portion 308*c* of the stability member 300*c*. The stability member 300 also includes tile engaging elements 302*c* comprised of several horizontally extending ribs 304*c* that laterally protrude from a side of the stabilizing arm 306*c*. The tile engaging elements 302*c* may frictionally "grip" the outer edge segments 106 of adjacent surface tiles 102 when the stability member is moved downwardly between the outer edge segments 106. The stability member may optionally be secured to an underlying surface (e.g., a support pedestal or beam) using a mechanical fastener 320.

To provide support for the surface tiles 102 and to provide a surface to which the stability member 300*c* may be attached, a support pedestal 201 having a top surface 220 may be provided. The support pedestal 201 supports the surface tile 102 by elevating the surface tile 102 above a fixed surface when the support pedestal 201 is wholly or partially disposed beneath the surface tile 102. The support pedestal 201 may be configured to receive the mechanical fastener 320 through the support plate to secure the stability member 300*c* to the support pedestal 201. For example, the support pedestal may include an aperture 221 for receiving that fastener 320. Alternatively, the fastener 320 may be of a type that does not require a receiving aperture, such as a self-tapping screw that can be driven into the support plate.

Figure 4:
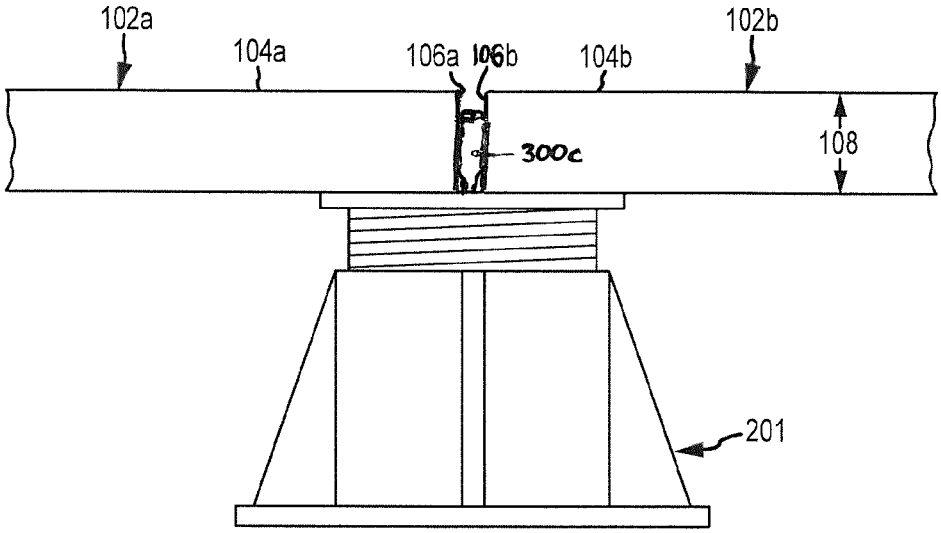
FIG. 4 illustrates a partial cross-sectional view of a stability member disposed between surface tiles that are supported by a support pedestal.

FIG. 4 illustrates a partial cut-away view of two adjacent surface tiles 102*a* and 102*b* that are supported by a support pedestal 201. That is, the surface tiles 102*a* and 102*b* are partially cut-away to better illustrate the disposition of the stability member 300*c* between the surface tiles 102*a*, 102*b*. The support pedestal 201 is disposed beneath adjacent outer edge segments 106*a* and 106*b* of the surface tiles 102*a* and 102*b*. The stability member 300*c* is disposed between the adjacent segments 106*a* and 106*b* and may be secured to the underlying support pedestal 201 using a mechanical fastener (not visible). The stability member 300*c* includes horizontally extending ribs that protrude from each side of the stabilizing arm such that the ribs frictionally engage the outer edge segments 106*a* and 106*b* when the stability member 300*c* is placed between the outer edge segments 106*a* and 106*b*. In this manner, the stability member 300*c* restricts relative movement (e.g., vertical and/or horizontal movement) of the adjacent surface tiles 102*a* and 102*b*, particularly by securing the surface tiles 102*a* and 102*b* to the support pedestal 201. It is a particular advantage of the embodiment illustrated in FIGS. 3 and 4 that the stability member 300*c* can grip the adjacent outer edge segments to restrict relative movement without requiring the outer edge segments to have any particular structure for receiving and engaging the stability member.

It should be noted that the height of the stabilizing member 300*c* is not greater than (e.g., is less than) the thickness 108 of the outer edge segments 106*a* and 106*b* so that the stabilizing member 300*c* may be fully disposed beneath the top surfaces 104*a* and 104*b*.

Figure 5:
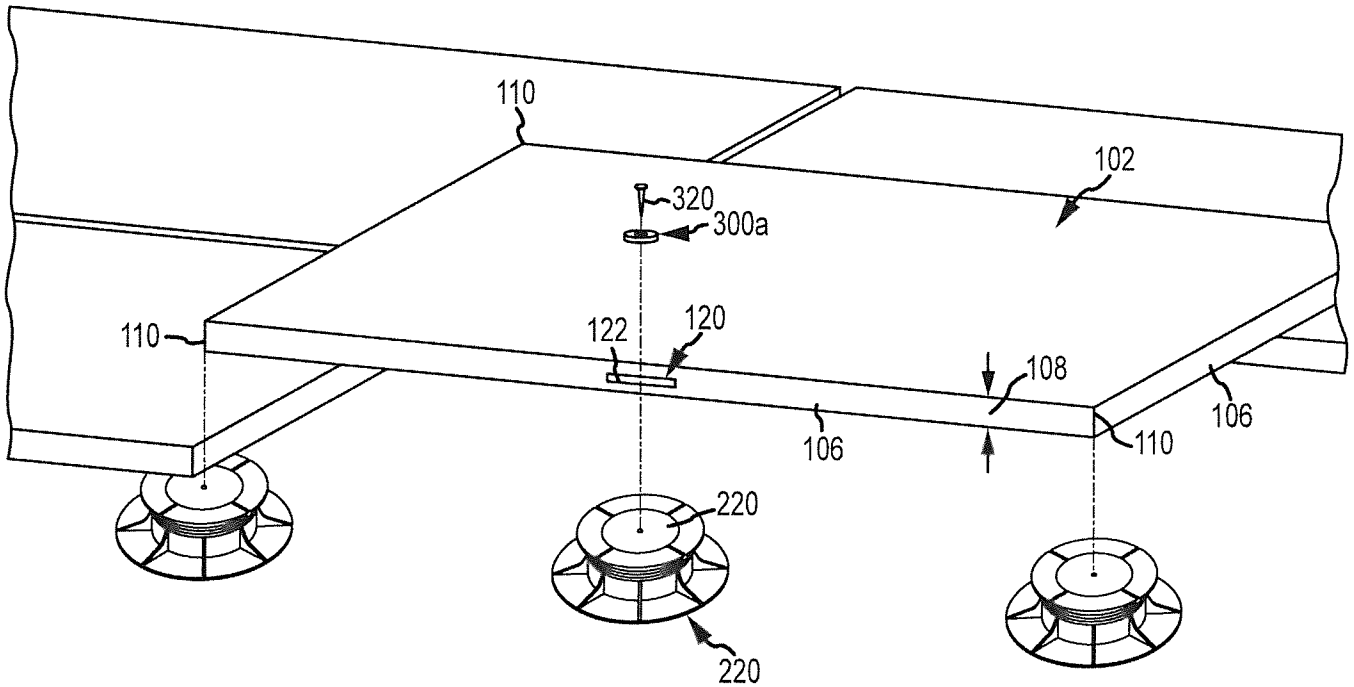
FIG. 5 illustrates an exploded perspective view of a building surface assembly.

FIG. 5 illustrates an alternative exemplary embodiment of a system for the assembly of a building surface in accordance with the invention. The system also includes a plurality of discrete building surface tiles 102 that may be disposed in spaced-apart relation to form a building surface. Building surface tiles 102 include a top surface 104, a plurality of corner portions 110 and a plurality of outer edge segments 106 that extend downwardly from the top surface 104 and have an outer edge segment thickness 108. As is described above, the outer edge segment thickness 108 may be, for example, at least about 1 inch and not greater than about 3 inches.

A stability member 300*a* is configured to be placed between two adjacent outer edge segments 106 of two adjacent building surface tiles 102, such that the stability member 300*a* restricts relative movement of the two adjacent building surface tiles when stability member 300*a* is disposed between the outer edge segments 106. As with FIG. 3 described above, for purposes of clarity FIG. 5 only illustrates one of the two adjacent surface tiles 102 between which the stability member 300*a* is disposed.

The stability member 300*a* is a washer form that is configured to be disposed within a stability member engaging portion 120 disposed on the outer edge segment 106 of the surface tile 102. As illustrated in FIG. 5, the stability member engaging portion 120 comprises an engagement channel 122 (e.g., a notch or slot) that is configured to operatively receive the stability member 300*a* within the engagement channel 122. Although not illustrated, the adjacent outer edge segment will also include a stability member engaging portion comprising an engagement channel to also receive and engage the stability member 300*a*.

As is described above with respect to FIG. 3, the support pedestal 201 supports the surface tile 102 by elevating the surface tile 102 above a fixed surface when support pedestal 201 is wholly or partially disposed beneath the surface tile 102. The support pedestal 201 may also be configured to receive a mechanical fastener 320 through the support plate to secure the stability member 300*a* to the support pedestal 201.

Figure 6:
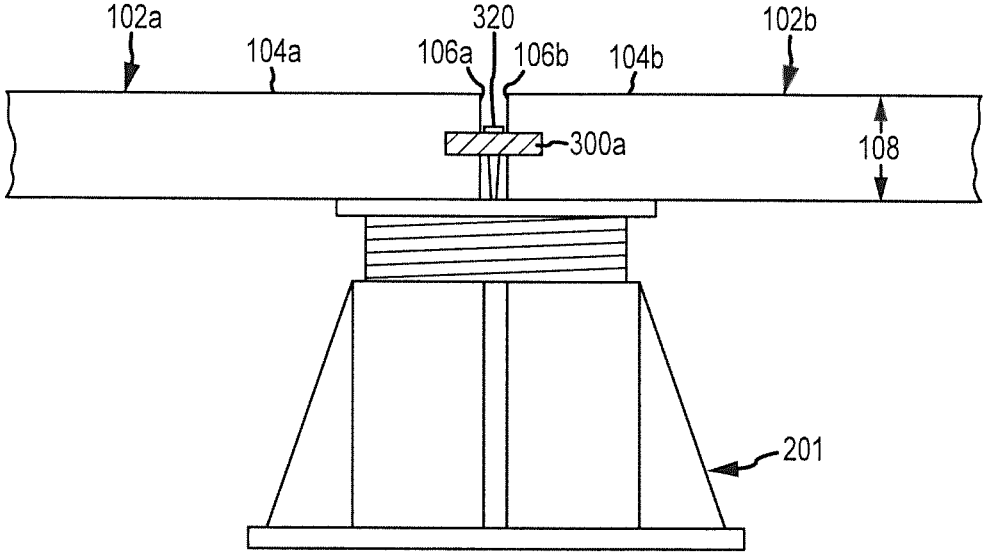
FIG. 6 illustrates a partial cross-sectional view of a stability member disposed between surface tiles that are supported by a support pedestal.

FIG. 6 illustrates a partial cut-away view of two adjacent surface tiles 102*a* and 102*b* that are supported by a support pedestal 201. That is, the surface tiles 102*a* and 102*b* are partially cut-away to better illustrate the disposition of the stability member 300*a* between the adjacent surface tiles 102*a* and 102*b*.

The support pedestal 201 is disposed beneath adjacent outer edge segments 106*a* and 106*b* of the surface tiles 102*a* and 102*b* to support the surface tiles, e.g., in conjunction with other support pedestals (not illustrated). The stability member 300*a* is disposed between the adjacent outer edge segments 106*a* and 106*b* and may be secured to the underlying support pedestal 201 using a mechanical fastener 320 (e.g., a threaded fastener).

The stability member 300*a* includes an outer periphery that is simultaneously disposed within the engagement channels formed in the outer edge segments 106*a* and 106*b*. The outer periphery of the washer form may have a thickness that is slightly less than or approximately equal to the width of the engagement channels. In this manner, relative movement of the adjacent surface tiles 102*a* and 102*b* can be restricted.

Figure 7:
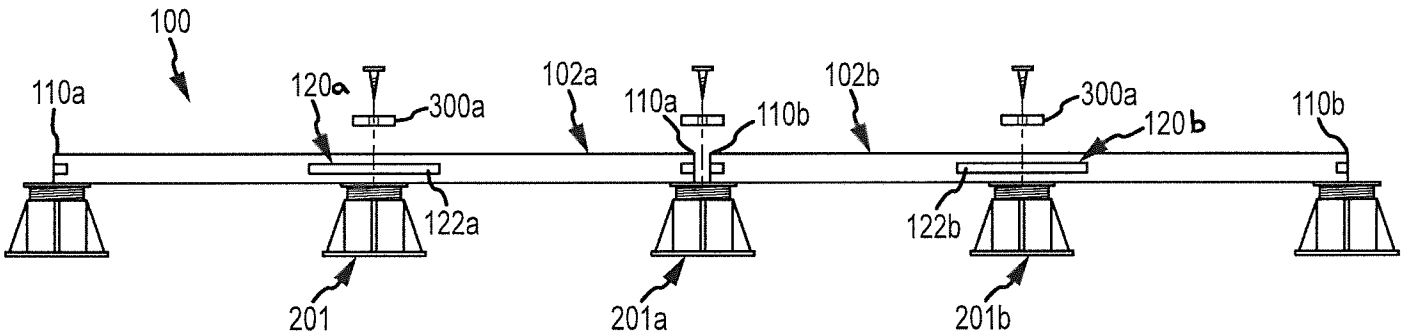
FIG. 7 illustrates a partial cross-sectional view of a building surface assembly.

FIG. 7 illustrates a partial cross-sectional view of a building surface assembly 100. The building surface assembly includes a plurality of support pedestals 201 that support surface tiles 102*a* and 102*b* above a fixed surface. The outer edge segments of the surface tiles 102*a* and 102*b* include stability member engagement portions 120*a* and 120*b* in the form of engagement channels 122*a* and 122*b* that are horizontally disposed along the outer edge segments. Specifically, the engagement channels 122*a* and 122*b* are disposed between corner portions 110*a* and 110*b* of the surface tiles and do not transect the corner portions 110*a* and 110*b* of the surface tiles. As illustrated in FIG. 7, the engagement channels 122*a* and 122*b* extend along a portion of the outer edge segments of the surface tiles such that they transect a central portion of the edge segment of the surface tiles, e.g., a portion that is disposed between the two corner portions of the outer edge segment without intersecting the corner portions.

Thus, as is described above, a stability member 300*a* may be disposed within the engagement channels 122 to secure the surface tiles 102*a* and 102*b* to the support pedestal 201. Also, as is illustrated in FIG. 7, stability members may optionally be placed within corner portions 110*a* and 110*b* of the surface tiles 102*a* and 102*b*. Such structures are described in further detail in commonly-owned U.S. patent application Ser. No. 13/094,364, which is incorporated herein by reference in its entirety.

It will be appreciated that the stability members may take a variety of shapes, so long as the stability member is configured to operatively engage the outer edge segments of adjacent surface tiles to restrict relative movement between the adjacent surface tiles.

Figure 8A:
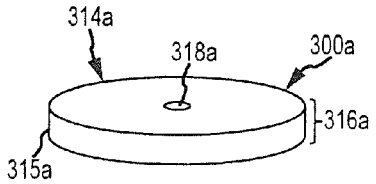
FIGS. 8*a* to 8*e* illustrate various embodiments of a stability member.
Figure 8B:
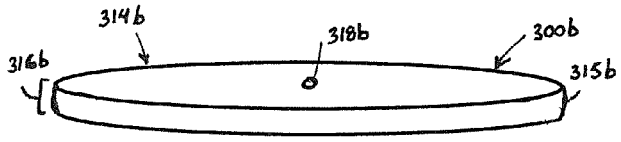

FIGS. 8*a* to 8*e* illustrate various embodiments of stability members in accordance with the present invention. FIGS. 8*a* and 8*b* illustrate stability members 300*a* and 300*b* that comprise washer forms 314*a* and 314*b*, respectively. As used herein, washer forms may generally include a disk-like element having an outer periphery (e.g., an arcuate or circular outer periphery). For example, washer form 314*a* comprises a substantially flat and round washer, whereas washer form 314*b* comprises a biscuit-like (e.g., oblong) structure. In any event, each of the washer forms 314*a* and 314*b* includes an outer periphery 315*a*, 315*b* having an outer periphery thickness 316*a*, 316*b*, respectively between top and bottom surfaces of the washer forms. As is illustrated in FIG. 6, the thickness of the outer periphery of the washer forms may be slightly less or substantially equal to the width of an engagement channel within an outer edge segment of the surface tiles. The washer forms 300*a*, 300*b* may also include apertures 318*a*, 318*b* that are configured to receive a mechanical fastener therethrough to secure the washer forms 300*a*, 300*b* to an underlying support surface. It will also be appreciated that the outer periphery of a washer form may have a variety of other shapes such as a polygonal shape, e.g., a rectangle, hexagon and the like.

Figure 8C:
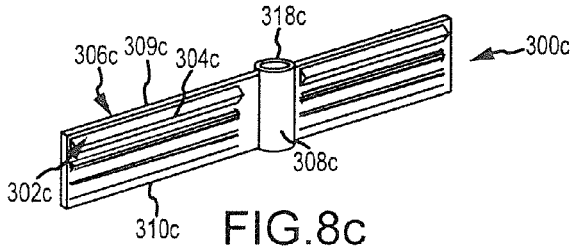

FIG. 8*c* illustrates a stability member 300*c* substantially as described with respect to FIGS. 3-4 above. The stability member 300*c* includes a stabilizing arm 306*c* that extends substantially horizontally along a length of the stability member 300*c*, such as extending from a central portion 308*c* of the stability member 300*c*. The stabilizing arm has a top edge 309*c* and a bottom edge 310*c*, and a tile-engaging element 302*c* is disposed on a surface of the stabilizing arm 306*c*. As illustrated in FIG. 8*c*, the tile engaging element 302*c* includes a plurality of horizontally extending ribs 304*c* that protrude laterally from the side of the stabilizing arm 306*c* between the top edge 309*c* and the bottom edge 310*c*. The horizontally extending ribs 304*c* are larger (e.g., thicker) proximate to the top edge 309*c* and are smaller (e.g., narrower) proximate to the bottom edge 310*c* of the stabilizing arm 306*c*. In this manner, the stability member 300*c* may be inserted between adjacent outer edge segments of adjacent surface tiles such that the frictional engagement between the stability member and the surface tiles increases as the stability member 300*c* is forced downwardly between the adjacent outer edge segments and as the larger ribs begin to engage the outer edge segments.

Although not illustrated in FIG. 8*c*, a substantially similar tile engaging element structure as structure 302*c* may be disposed on an opposite side of the stability member 300*c* (see FIG. 4).

The stability member 300*c* also includes an aperture 318*c* vertically extending through the stability member 300*c* along the central portion 308*c* of the stability member 300*c*. In this manner, a mechanical fastener may be placed through the aperture 318*c* to secure the stability member 300*c* to an underlying support surface.

As is noted above with respect to FIGS. 3 and 4, it is an advantage of this particular embodiment that the stability member 300*c* may be utilized to restrict movement of adjacent surface tiles without requiring the outer edge segments of the adjacent surface tiles to have any particular structure for receiving and engaging the stability member 300*c*. In this regard, it will be appreciated that other structures for the stability member can be envisioned. For example, the stabilizing arm 306*c* may be in the form of a wedge (e.g., a tapered shim) having a thickness that decreases from the top edge 309*c* to the bottom edge 310*c* without requiring horizontally extending ribs to grip and engage the outer edge segments of the adjacent surface tiles.

Figure 8D:
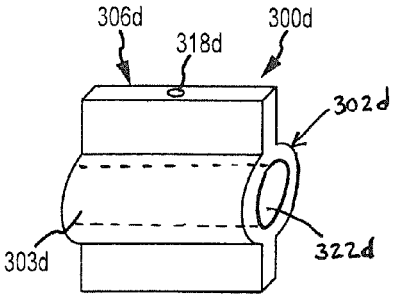
Figure 8E:
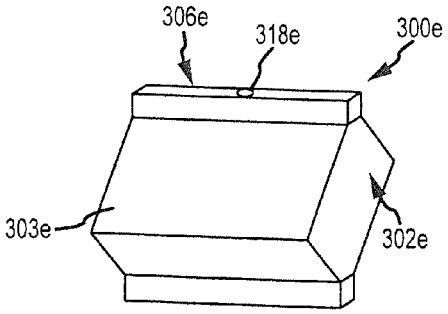

FIGS. 8*d* and 8*e* illustrate further embodiments of a stability member 300*d* and 300*e* according to the present invention. FIG. 8*d* illustrates a stability member 300*d* having a tile engaging element 302*d* that includes a horizontally extending arcuate surface portion 303*d* laterally protruding from the sides of a stabilizing arm 306*d*. The arcuate surface portion 303*d* may be configured to be disposed within a receiving engagement channel in the outer edge segment of a surface tile, e.g., where the engagement channel comprises an arcuate channel adapted to matingly receive and secure the arcuate surface portion 303*d*. As illustrated in FIG. 8*d*, the stabilizing arm 306*d* includes an inner hollow portion 322*d* adjacent the tile engaging element 302*d*. In this manner, the tile engaging element 302*d* (e.g., the arcuate surface portion 303*d*) may expand outwardly to compression fit between two adjacent outer edge segments of adjacent surface tiles when a force (e.g., from a threaded fastener) is exerted on the top of the stabilizing arm 306*d*. Alternatively, or in addition, the stabilizing arm 302*d* may be fabricated from a resilient and compressible material, such as rubber.

Similarly, FIG. 8*e* illustrates a stability member 300*e* having a tile engaging element 302*e* that includes a horizontally extending oblique surface portion 303*e* laterally protruding from the sides of the single stabilizing arm 306*e*. The oblique surface portion 303*e* may be configured to be operatively disposed within an engagement channel in the outer edge of a surface tile having a mating surface structure (i.e., an engagement channel having an oblique cross-section) of similar size and dimensions as the oblique surface portion 303*e*.

Each of the stability members 300*d* and 300*e* may also include apertures 318*d* and 318*e* respectively that vertically extend through the stability members 300*d* and 300*e* and are configured to receive mechanical fasteners therethrough to secure the stability members to an underlying support surface.

In any of the embodiments illustrated in FIGS. 8*c*, FIG. 8*d* and FIG. 8*e*, the stabilizing arm may have a length, such of at least ¼ inch. Further, the tile engaging elements may protrude laterally from the stabilizing arm by at least about 1/32 inch, such as by at least ⅛ inch, to securely engage the outer edge segments of the surface tiles. Further, the height of the stability members may be less than the thickness of the outer edge segments of the surface tiles such that the stability members may be disposed completely below a top surface of the surface tiles.

The present invention may also encompass a method for the construction of a building surface assembly including several of the components described above. For example, a method may include the steps of partially inserting a stability member into a stability member engaging portion (e.g., an engagement channel) disposed in an outer edge segment of a first surface tile, and then placing a second surface tile adjacent the first surface tile such that the stability member is partially engaged with a stability member engaging portion (e.g., an engagement channel) in the second surface tile. The stability member may be secured to one or both of the stability member engaging portions using, e.g., an adhesive to facilitate construction. The stability member may then be secured to an underlying surface (e.g., a support pedestal, a beam or a bracing element) to inhibit relative movement between the first and second surface tiles. This process may be repeated with a plurality of surface tiles to form a building surface that is structurally stable.

In another method, a plurality of surface tiles having outer edge segments are operatively arranged to form a building surface, e.g., by placing outer edge segments of adjacent surface tiles in proximal spaced-apart relation. A stability member may them be inserted between the outer edge segments of adjacent surface tiles and forced downwardly to frictionally engage each of the adjacent outer edge segments. The stability member may be secured to an underlying surface (e.g., a support pedestal, a beam or a bracing element) to inhibit relative movement between the adjacent surface tiles. This process may be repeated with a plurality of outer edge segments of a plurality of surface tiles to form a building surface that is structurally stable.

While various embodiments of the present invention have been described in detail, it is apparent that modifications and adaptation of those embodiments will occur to those skilled in the art. However, it is to be expressly understood that such modifications and adaptations are within the scope of the present invention.

What is claimed is:

1. A structural system for supporting a plurality of building surface tiles, comprising:

a plurality of support pedestals, the support pedestals comprising a support plate having a top surface and being configured to operatively support a plurality of building surface tiles in horizontally spaced-apart relation; and a plurality of stability members that are configured to be disposed between adjacent building surface tiles operatively arranged to form a building surface, the stability members comprising:

i. a central portion; and ii. a stabilizing arm extending horizontally away from the central portion, wherein the stabilizing arm has a top edge, a bottom edge, and at least a first tile-engaging element protruding laterally from a first side of the stabilizing arm between the top edge and the bottom edge thereof, and wherein a substantial entirety of the stabilizing arm is configured to be disposed between adjacent outer edge segments of the adjacent building surface tiles.

2. The system recited in claim 1, wherein the stabilizing arm further comprises at least a second tile engaging element protruding laterally from the stabilizing arm between the top edge and the bottom edge thereof.

3. The system recited in claim 2, wherein the first tile engaging element protrudes from a first side of the stabilizing arm and the second tile engaging element protrudes from a second side of the stabilizing arm opposite the first side.

4. The system recited in claim 3, wherein the first and second tile engaging elements comprise horizontally extending ribs laterally protruding from the first and second sides of the stabilizing arm.

5. The system recited in claim 1, wherein the stability members comprise a vertically extending aperture disposed through the stability members.

6. The system recited in claim 5, comprising a plurality of mechanical fasteners that are configured to be placed through the vertically extending apertures to secure the stability members to the support plates.

7. The system recited in claim 1, wherein the stabilizing arm has a length of at least about ¼ inch.

8. The system as recited in claim 7, wherein the first tile engagement element protrudes laterally from the stabilizing arm by at least about 1/32 inch.

9. The system recited in claim 7, wherein the first tile engagement element protrudes laterally from the stabilizing arm by at least about ⅛ inch.

10. The system recited in claim 1, wherein the support pedestals comprise a base plate and a central section interconnecting the base plate and the support plate.

11. The system recited in claim 1, wherein the stability members are fabricated from a material selected from the group consisting of wood, natural stone, concrete, metal, polymers, plastic or composites thereof.

12. A structural system for supporting a plurality of building surface tiles, comprising:

a plurality of support pedestals, the support pedestals comprising a support plate having a top surface and being configured to operatively support a plurality of building surface tiles in horizontally spaced-apart relation; and a plurality of stability members that are configured to be disposed between adjacent building surface tiles operatively arranged to form a building surface, the stability members comprising:

i. a central portion; and ii. a stabilizing arm extending horizontally away from the central portion, where the stabilizing arm has a top edge, a bottom edge, and at least a first tile-engaging element protruding laterally from a first side of the stabilizing arm between the top edge and the bottom edge thereof, wherein the stabilizing arm further comprises at least a second tile engaging element protruding laterally from the stabilizing arm between the top edge and the bottom edge thereof, wherein the first tile engaging element protrudes from a first side of the stabilizing arm and the second tile engaging element protrudes from a second side of the stabilizing arm opposite the first side, and wherein the first and second tile engaging elements comprise a horizontally extending arcuate or oblique surface portion laterally protruding from the sides of the stabilizing arm.

13. A system for assembling a building surface, comprising:

a plurality of building surface tiles, the building surface tiles comprising a top surface, a plurality of corner portions, and a plurality of outer edge segments disposed between the corner portions, the outer edge segments extending downwardly from the top surface and having an outer edge segment thickness; and a plurality of stability members that are configured to be placed between two adjacent outer edge segments of two adjacent building surface tiles, such that the stability members are disposed below the top surfaces of the building surface tiles and are at least partially disposed within adjacent stability member engaging portions that are disposed in the two adjacent outer edge segments of the two adjacent building surface tiles, wherein the stability member engaging portions comprise respective engagement channels formed in the outer edge segments.

14. The system recited in claim 13, comprising:

a plurality of support pedestals that are configured to vertically elevate the building surface tiles above a fixed surface, the support pedestals comprising a support plate having a top surface that is configured to support the building surface tiles.

15. The system recited in claim 13, wherein the stability members comprise a washer form having an outer periphery.

16. The system recited in claim 15, wherein the washer form outer peripheries are configured to simultaneously engage adjacent engagement channels to restrict movement of the building surface tiles.

17. The system recited in claim 16, wherein the outer periphery of the washer forms has a thickness that is approximately equal to or slightly less than the width of the engagement channels.

18. The system recited in claim 13, wherein the stability members comprise a stabilizing arm horizontally extending along a length of the stability members.

19. The system recited in claim 18, wherein the stabilizing arm horizontally extends from a central portion of the stability members.

20. The system recited in claim 18, wherein the stabilizing arm comprises at least a first tile engaging element protruding laterally from a first side of the stabilizing arm.

21. The system recited in claim 20, wherein the stabilizing arm further comprises at least a second tile engaging element protruding laterally from the stabilizing arm.

22. The system recited in claim 21, wherein the first tile engaging element protrudes from a first side of the stabilizing arm and the second tile engaging element protrudes from a second side of the stabilizing arm.

23. The system recited in claim 22, wherein the first and second tile engaging elements comprise a horizontally extending oblique surface portion laterally protruding from the sides of the stabilizing arm.

24. The system recited in claim 20, wherein each of the engagement channels is configured to operatively receive the first tile engaging element of one of the stabilizing arms.

25. The system recited in claim 24, wherein the engagement channels extend along a portion of the outer edge segments of the building surface tiles.

26. The system recited in claim 25, wherein the engagement channels transect a central portion of the outer edge segments of the building surface tiles.

27. The system recited in claim 13, wherein the building surface tiles are comprised of concrete.

28. The system recited in claim 13, wherein the building surface tiles are comprised of a material selected from the group consisting of wood, stone, plastic, metal and composites.

29. The system recited in claim 13, wherein the building surface tiles comprise at least three corner portions and at least three edge segments.

30. The system recited in claim 13, wherein the edge segment thickness is at least about 1 inch and is not greater than about 3 inches.

31. The system recited in claim 30, wherein the stability members comprise a vertically extending aperture disposed through the stability member that is configured to operatively receive the mechanical fasteners therethrough.

32. The system recited in claim 13, comprising a plurality of mechanical fasteners that are configured to secure the stability members to an underlying support.

33. A system for assembling a building surface, comprising:

a plurality of building surface tiles, the building surface tiles comprising a top surface, a plurality of corner portions, and a plurality of outer edge segments disposed between the corner portions, the outer edge segments extending downwardly from the top surface and having an outer edge segment thickness; and a plurality of stability members that are configured to be placed between two adjacent outer edge segments of two adjacent building surface tiles, such that the stability members are disposed below the top surfaces of the building surface tiles and are at least partially disposed within adjacent stability member engaging portions that are disposed in the two adjacent outer edge segments of the two adjacent building surface tiles, wherein the stability members comprise a stabilizing arm horizontally extending along a length of the stability members, wherein the stabilizing arm comprises at least a first tile engaging element protruding laterally from a first side of the stabilizing arm, wherein the stabilizing arm further comprises at least a second tile engaging element protruding laterally from the stabilizing arm, wherein the first tile engaging element protrudes from a first side of the stabilizing arm and the second tile engaging element protrudes from a second side of the stabilizing arm, and wherein the first and second tile engaging elements comprise a horizontally extending arcuate or oblique surface portion laterally protruding from the sides of the stabilizing arm.

34. A system for assembling a building surface, comprising:

a plurality of building surface tiles, the building surface tiles comprising a top surface, a plurality of corner portions, and a plurality of outer edge segments disposed between the corner portions, the outer edge segments extending downwardly from the top surface and having an outer edge segment thickness; and a plurality of stability members that are configured to be placed between two adjacent outer edge segments of two adjacent building surface tiles, such that the stability members are disposed below the top surfaces of the building surface tiles and are at least partially disposed within adjacent stability member engaging portions that are disposed in the two adjacent outer edge segments of the two adjacent building surface tiles, wherein the stability, members comprise a stabilizing arm horizontally extending along a length of the stability members, and wherein the stabilizing arm comprises at least a first tile engaging element protruding laterally from a first side of the stabilizing arm, wherein the stability member engaging portions comprise an engagement channel for operatively receiving the tile engaging element, wherein the engagement channels extend along a portion of the outer edge segments of the building surface tiles, and wherein the engagement channels do not transect the corner portions of the surface tiles.

35. A building surface assembly, comprising:

a plurality of building surface tiles, the building surface tiles comprising a top surface, a plurality of corner portions, and a plurality of outer edge segments disposed between the corner portions, the outer edge segments extending downwardly from the top surface and having an outer edge segment thickness; and a plurality of stability members disposed between adjacent outer edge segments of adjacent building surface tiles, wherein the stability members are received in engagement channels formed in the outer edge segments of the adjacent building surface tiles to restrict relative movement of the surface tiles.

36. The assembly recited in claim 35, wherein the stability members are secured to an underlying tile support.

37. The assembly recited in claim 35, further comprising a plurality of support pedestals, at least a portion of the support pedestals being disposed beneath outer edge segments of adjacent building surface tiles to vertically support and elevate the building surface tiles above a fixed surface, the support pedestals comprising a support plate having a tile support surface that supports the building surface tiles.

38. The assembly recited in claim 35, wherein the stability members comprise a washer form having an outer periphery.

39. The assembly recited in claim 38, wherein the outer periphery of the washer forms simultaneously engages the engagement channels of adjacent surface tiles to restrict relative movement of the surface tiles.

40. The assembly recited in claim 35, wherein the stability members comprise a stabilizing arm horizontally extending along a length of the stability members.

41. The assembly recited in claim 40, wherein the stabilizing arm horizontally extends from a central portion of the stability members.

42. The assembly recited in claim 40, wherein the stabilizing arms are operatively engaged with the engagement channels.

43. The assembly recited in claim 42, wherein the stabilizing arms comprise at least a first tile engaging element laterally protruding from a first side of the stabilizing arms and wherein the engagement channels operatively receive the first tile engaging elements.

44. The assembly recited in claim 43, wherein the stabilizing arms further comprises at least a second tile engaging element laterally protruding from a second side of the stabilizing arms.

45. The assembly recited in claim 44, wherein the first and second tile engaging elements comprise a horizontally extending oblique surface portion laterally protruding from the sides of the stabilizing arm.

46. The assembly recited in claim 43, wherein the engagement channels transect a central portion of the edge segments of the surface tiles.

47. The assembly recited in claim 35, wherein the surface tiles are comprised of concrete.

48. The assembly recited in claim 35, wherein the building surface tiles are comprised of a material selected from the group consisting of wood, stone, plastic, metal and composites.

49. The assembly recited in claim 35, wherein the building surface tiles comprise at least three corner portions and at least three edge segments.

50. The assembly recited in claim 35, further comprising a plurality of mechanical fasteners securing the stability members to the underlying tile support.

51. The assembly recited in claim 50, wherein the stability members comprise vertically extending apertures therethrough that operatively receive the mechanical fasteners.

52. The assembly recited in claim 36, wherein the underlying tile support comprises the top surface of a support pedestal.

53. A building surface assembly, comprising:

a plurality of building surface tiles, the building surface tiles comprising a top surface, a plurality of corner portions, and a plurality of outer edge segments disposed between the corner portions, the outer edge segments extending downwardly from the top surface and having an outer edge segment thickness; and a plurality of stability members disposed between adjacent edge segments of adjacent building surface tiles, wherein the stability members are operatively engaged with the outer edge segments of the building surface tiles to restrict relative movement of the surface tiles, wherein the stability members comprise a washer form having an outer periphery, wherein the outer edge segments of the surface tiles comprise an engagement channel, wherein the outer periphery of the washer forms simultaneously engages the engagement channels of adjacent surface tiles to restrict relative movement of the surface tiles, and wherein the outer periphery of the washer form has a thickness that is approximately equal to or slightly less than the width of the engagement channel.

54. A building surface assembly, comprising:

a plurality of building surface tiles, the building surface tiles comprising a top surface, a plurality of corner portions, and a plurality of outer edge segments disposed between the corner portions, the outer edge segments extending downwardly from the top surface and having an outer edge segment thickness; and a plurality of stability members disposed between adjacent edge segments of adjacent building surface tiles, wherein the stability members are operatively engaged with the outer edge segments of the building surface tiles to restrict relative movement of the surface tiles, wherein the stability members comprise a stabilizing arm horizontally extending along a length of the stability members, wherein the outer edge segments of the surface tiles comprise stability member engaging portions, wherein the stabilizing arms are operatively engaged with the stability member engaging portions, wherein the stabilizing arms comprise at least a first tile engaging element laterally protruding from a first side of the stabilizing arms, wherein the stability member engaging portions comprise an engagement channel that operatively receives the first tile engaging element, wherein the stabilizing arm further comprises at least a second tile engaging element laterally protruding from a second side of the stabilizing arm, and wherein the first and second tile engaging elements comprise a horizontally extending arcuate or oblique surface portion laterally protruding from the sides of the stabilizing arm.

55. A building surface assembly, comprising:

a plurality of building surface tiles, the building surface tiles comprising a top surface, a plurality of corner portions, and a plurality of outer edge segments disposed between the corner portions, the outer edge segments extending downwardly from the top surface and having an outer edge segment thickness; and a plurality of stability members disposed between adjacent edge segments of adjacent building surface tiles, wherein the stability members are operatively engaged with the outer edge segments of the building surface tiles to restrict relative movement of the surface tiles, wherein the stability members comprise a stabilizing arm horizontally extending along a length of the stability members, wherein the outer edge segments of the surface tiles comprise stability member engaging portions, wherein the stabilizing arms are operatively engaged with the stability member engaging portions, wherein the stabilizing arms comprise at least a first tile engaging element laterally protruding from a first side of the stabilizing arms, wherein the stability member engaging portions comprise an engagement channel that operatively receives the first tile engaging element, and wherein the engagement channels do not transect the corner portions of the surface tiles.

* * * * *